US009199782B1

(12) United States Patent
Cliatt

(10) Patent No.: US 9,199,782 B1
(45) Date of Patent: Dec. 1, 2015

(54) PORTABLE COOLER

(71) Applicant: Larry Cliatt, Orlando, FL (US)

(72) Inventor: Larry Cliatt, Orlando, FL (US)

( * ) Notice: Subject to any disclaimer, the term of this patent is extended or adjusted under 35 U.S.C. 154(b) by 0 days.

(21) Appl. No.: 14/036,353

(22) Filed: Sep. 25, 2013

(51) Int. Cl.
*B65D 81/38* (2006.01)

(52) U.S. Cl.
CPC ..... *B65D 81/3813* (2013.01)

(58) Field of Classification Search
USPC ..... 280/47.26, 47.34, 47.35; 220/592.01, 220/592.03, 592.04, 592.05, 592.09, 220/592.15, 592.2, 592.24, 600, 604, 630
See application file for complete search history.

(56) References Cited

U.S. PATENT DOCUMENTS

| | | | | | |
|---|---|---|---|---|---|
| 3,069,869 | A | * | 12/1962 | Mueller | 62/371 |
| 3,395,550 | A | | 8/1968 | Dungan | |
| 4,047,633 | A | * | 9/1977 | Trombly | 220/592.2 |
| D247,648 | S | * | 3/1978 | Carroll et al. | D3/312 |
| 4,162,029 | A | * | 7/1979 | Gottsegen et al. | 222/131 |
| 4,249,392 | A | * | 2/1981 | Hotta | 62/457.7 |
| 4,577,475 | A | * | 3/1986 | Herrera | 62/457.1 |
| 4,830,190 | A | * | 5/1989 | Inagaki | 206/550 |
| 4,896,790 | A | * | 1/1990 | Gronnevik | 220/592.01 |
| 4,917,256 | A | * | 4/1990 | Kruck et al. | 220/4.28 |
| 4,932,677 | A | * | 6/1990 | Shustack | 280/28.5 |
| 5,222,631 | A | | 6/1993 | Hood | |
| 5,249,438 | A | * | 10/1993 | Rhaney et al. | 62/457.7 |
| 5,259,215 | A | * | 11/1993 | Rocca | 62/371 |
| 5,306,029 | A | * | 4/1994 | Kaiser, II | 280/30 |
| 5,313,817 | A | * | 5/1994 | Meinders | 62/457.1 |
| 5,407,218 | A | * | 4/1995 | Jackson | 280/30 |
| 5,425,545 | A | * | 6/1995 | McCusker | 280/30 |
| 5,683,097 | A | * | 11/1997 | Fenton et al. | 280/655.1 |
| 5,797,236 | A | * | 8/1998 | Posey et al. | 52/664 |
| 5,839,738 | A | * | 11/1998 | Ozark | 280/30 |
| 6,364,329 | B1 | * | 4/2002 | Holub et al. | 280/47.26 |
| 6,463,756 | B1 | * | 10/2002 | Lewis | 62/457.7 |
| 6,675,606 | B1 | | 1/2004 | Jones et al. | |
| 6,763,678 | B2 | | 7/2004 | Harper | |
| 8,256,156 | B1 | * | 9/2012 | Burgoyne, Jr. | 43/54.1 |
| 8,561,832 | B2 | * | 10/2013 | Hassell | 220/628 |
| 2007/0125118 | A1 | | 6/2007 | Hooper | |
| 2010/0212351 | A1 | | 8/2010 | Chapin et al. | |
| 2014/0054297 | A1 | * | 2/2014 | Patstone | 220/592.01 |

* cited by examiner

*Primary Examiner* — Paul N Dickson
*Assistant Examiner* — Bridget Avery
(74) *Attorney, Agent, or Firm* — Thomas Frost

(57) ABSTRACT

A cooler with bladders filled with liquid attached to dispensers and placed in the interior of the cooler. The base of the cooler has recesses and channels to capture melted ice and provide cooling for the bladders. There is a front telescoping handle and a rear telescoping handle with a pair of wheels for transport. A pair of dispensers at equidistance apart, each having a control mechanism and an outlet, is mateable with bladders with either one or two liquid conduits.

8 Claims, 5 Drawing Sheets

10
22
24
12

14
40
60
40
18

PORTABLE COOLER

BACKGROUND OF INVENTION

The present invention relates to a portable cooler having a pair of bladders for liquid containment connectable to a pair of dispensers, a base floor for melted ice overflow to cool the liquid in the bladders, and a pair of opposed telescoping handles for transport.

It is an object of the invention to a pair of bladders for storing liquid, such as soda, connectable to a pair of dispensers.

It is another object of the invention to provide a base floor having recessed wells formed with recessed channels to capture melted ice and further cool the liquid in the bladders.

It is another object of the invention a strainer for food and ice storage which is removeable from the cooler.

SUMMARY OF THE INVENTION

The general purpose of the present invention, which will be described subsequently in greater detail, is to provide new and improved portable cooler.

The invention is a cooler with bladders filled with liquid attached to a faucet and placed in the interior of the cooler. Ice is placed in a strainer to cool the bladders and other food contents. The base of the cooler has indentations for water flow. There is a front telescoping handle and a rear telescoping handle with a pair of wheels.

A pair of dispensers at equidistance apart, each having a control mechanism and an outlet, is constructed through the front wall. A handle with a pair of arms is hingedly attached near the top edge of the front wall. Bladders for liquids are provided which can mate with the inlet of the dispenser positioned within the inner wall of the cooler. There are two bladders with a single outlet or one bladder with two outlets to connect to both dispensers.

A strainer, having an outer lip, mounts on an inner edge formed on the inner surface of the cooler. Formed on the floor of the cooler is a plurality of circular recesses formed with channels to accommodate melted ice.

BRIEF DESCRIPTION OF THE DRAWINGS

The invention will be better understood and objects other than those set forth above will become apparent when consideration is given to the following detailed description thereof. Such description makes reference to the annexed drawings wherein.

DETAILED DESCRIPTION OF THE INVENTION

Figure 1:
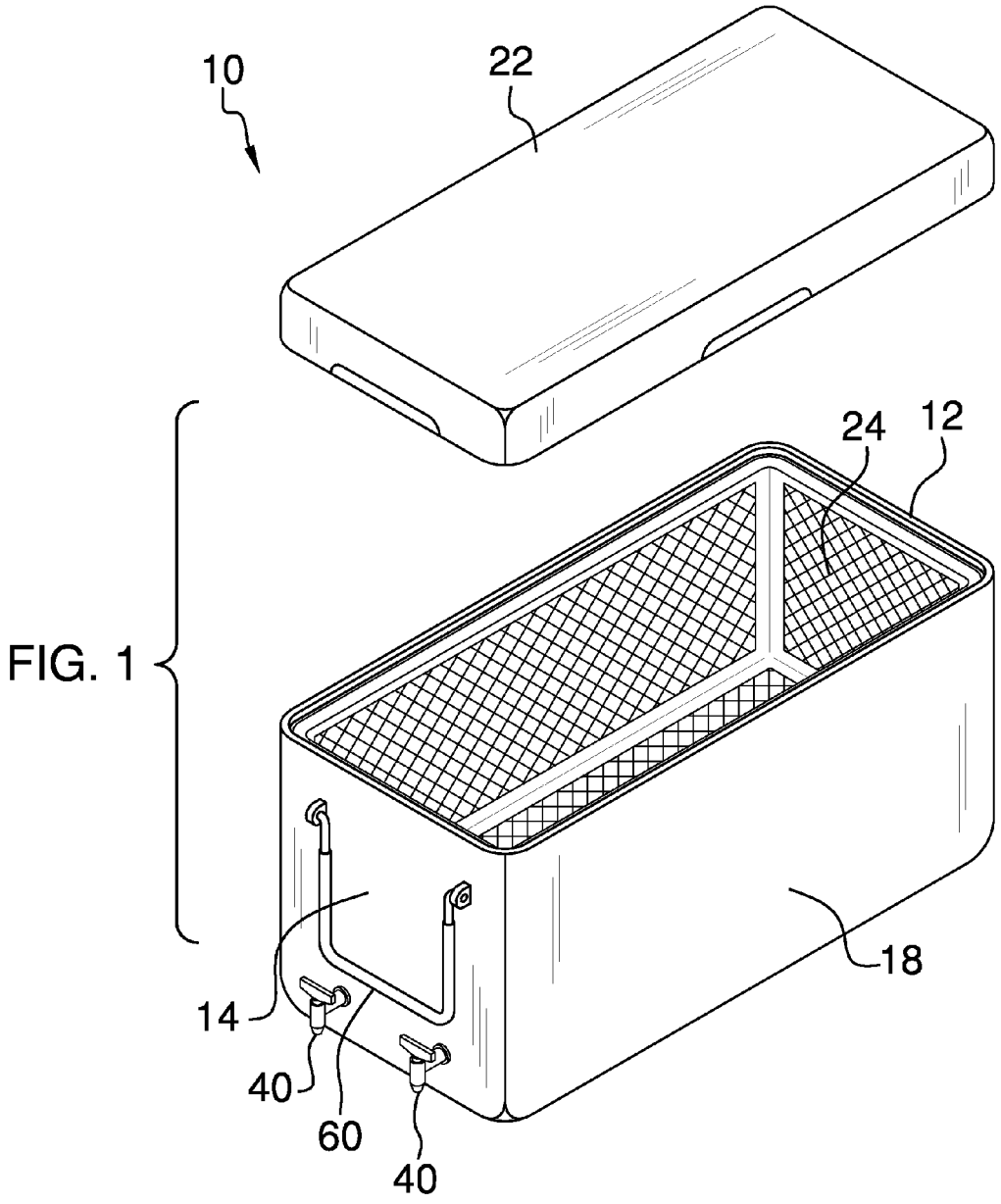
FIG. 1 is a front perspective view of the present invention with a lid removed.

Referring to the drawings in general, an embodiment of the present invention 10 will now be described in greater detail.

Referring to FIG. 1, the invention 10 comprises a body 12 formed of insulating material, such as Styrofoam. The body 12 has a vertical front wall 14, a vertical rear wall 16, vertical side walls 18 and a bottom wall 20. There is a cavity defined therein by the walls, and the walls each have an interior and exterior surface. A cover 22 is provided. The cover 22 may be attached by hinge means or detachable as illustrated. A bin 24 is dimensioned to be mounted in the body.

Figure 2:
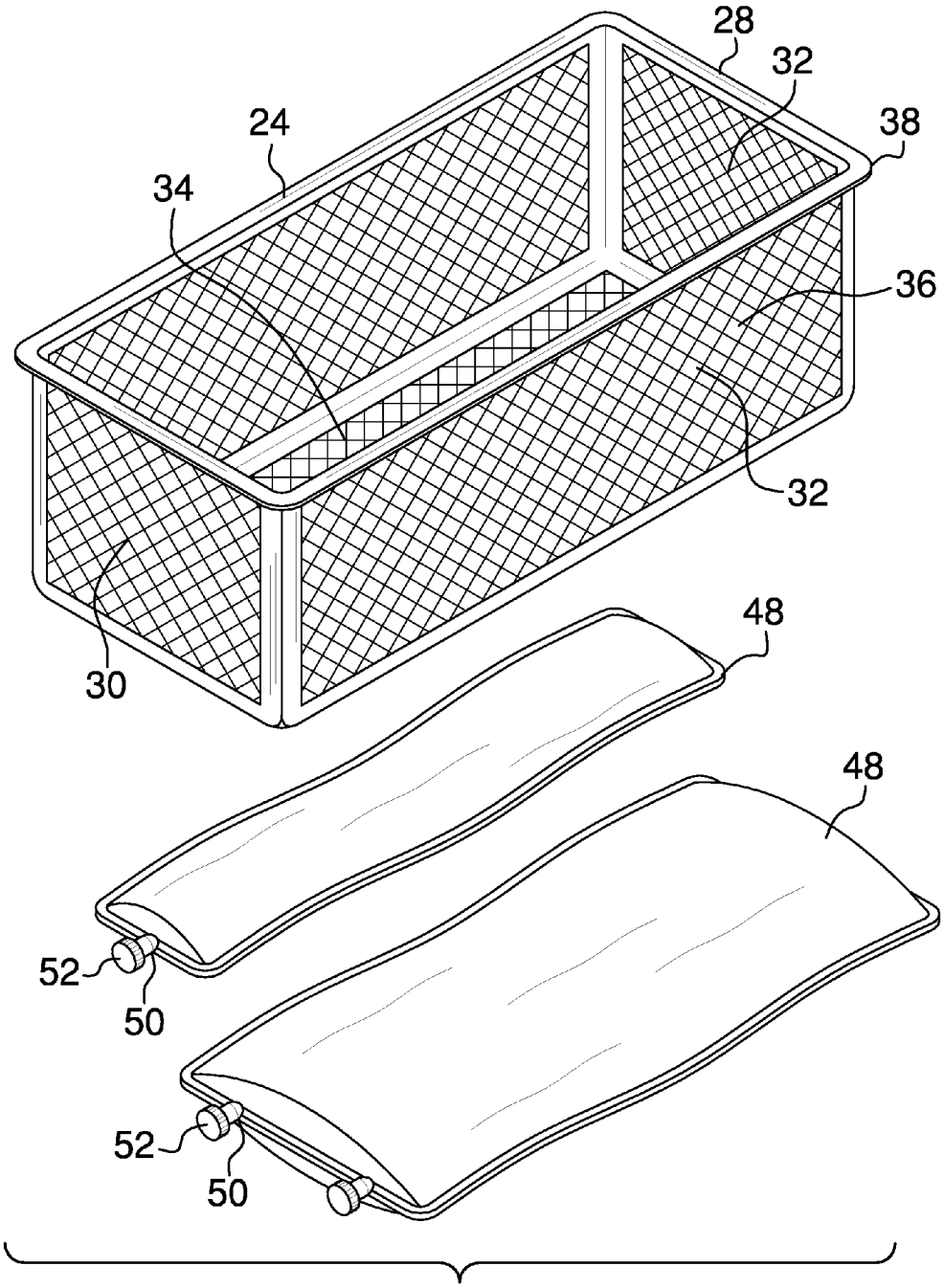
FIG. 2 is a perspective view of a container and bladders of the present invention.
Figure 4:
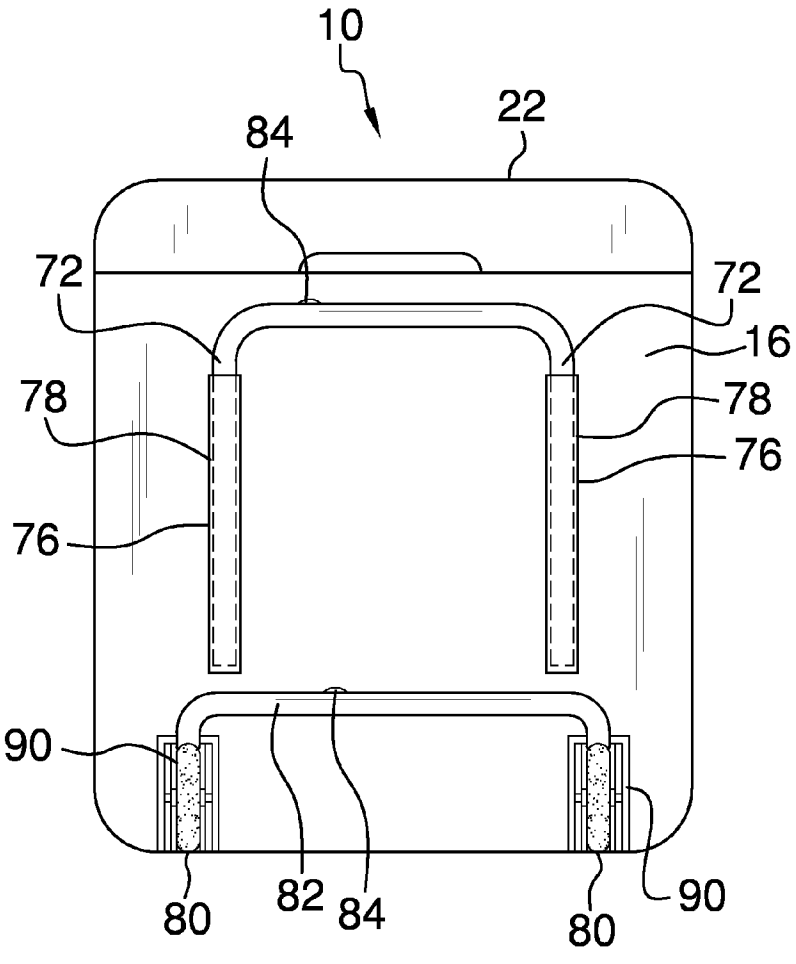
FIG. 4 is a rear plan view of the present invention.
Figure 3:
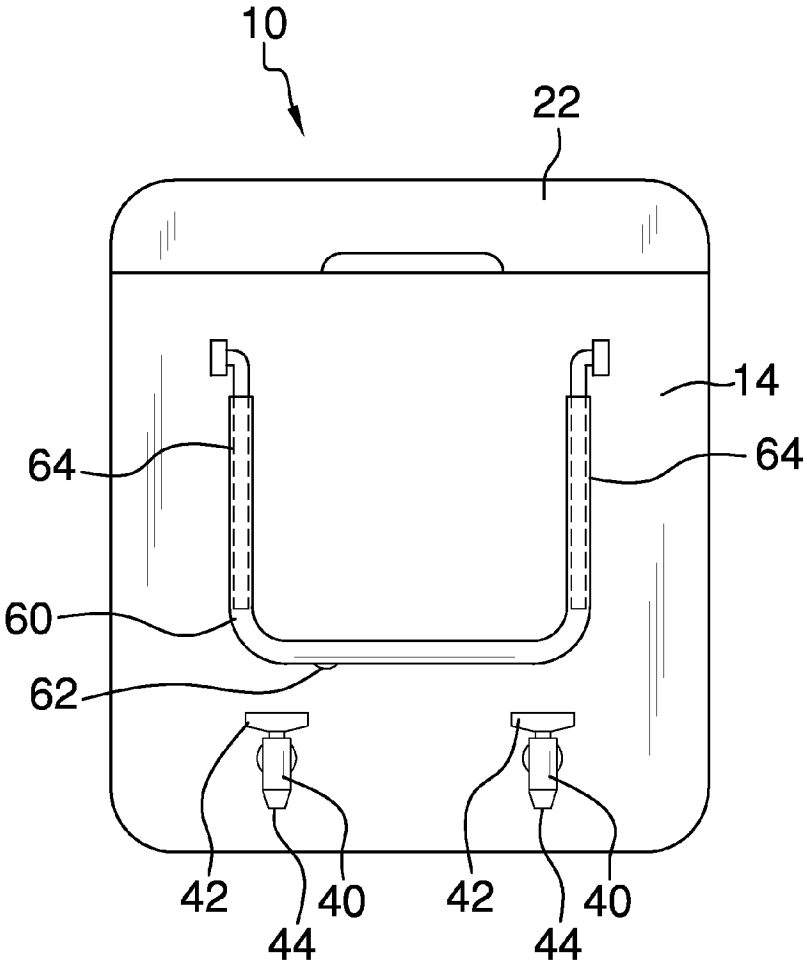
FIG. 3 is a front plan view of the present invention.
Figure 5:
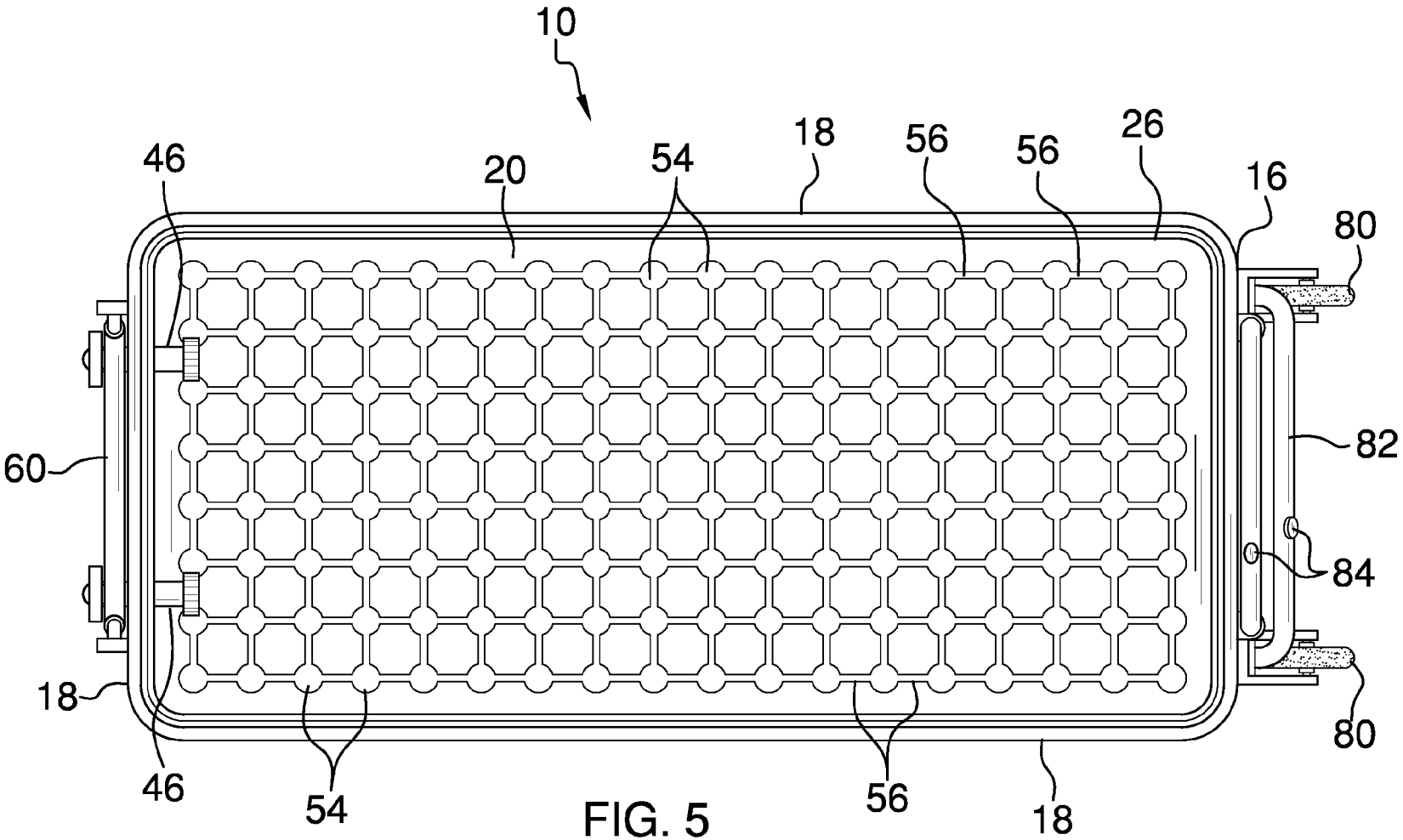
FIG. 5 is a top plan view of the present invention with the lid removed.

As shown in FIG. 5, an inner ridge 26 is formed along the inner surface of the walls of the body 12. As illustrated in FIGS. 1 and 2, the bin 24 is preferably a strainer 28 having end walls 30, side walls 32 and a bottom wall 34 with passages 36 formed through the walls thereto. A lip 38 depends outwardly, and allows the strainer 28 to be mounted on the inner ridge of the body 12. The strainer 28 holds ice and food products, and sits off of the bottom wall 20.

At least one dispenser 40, having a control mechanism 42 and providing an outlet 44, is disposed through the front wall 14 and via an outwardly threaded inlet port 46 is in communication with the interior cavity of the body 12. A liquid container 48 having a liquid conduit 50 and an internally threaded cap end 52, is mateable with the inlet port 46. As illustrated in FIG. 2, the container 48 can either have duel liquid conduits 50 to engage with a pair of dispensers 40. The container 48 can thus have the same liquid contents flowing through a pair of dispensers 40. The container is preferably a rubber bladder rubber, which is already well known. It can be flattened to lie on the bottom wall 20 below the strainer 28.

As shown in FIG. 5, a plurality of recessed wells 54 and recessed channels 56 are formed in the interior surface of the bottom wall 20. The channels 56 are aligned parallel and perpendicular to each other forming a plurality of squares with the recessed wells 54 intersecting and connecting at the corner of each square. Ice positioned in the strainer 28 melts and cool water stands on the bottom wall 20. Since the recessed wells 54 and recessed channels 56 interlink, the temperature of the water is maintained at a constant. The liquid contents of the liquid containers 48 can thus be maintain at a lower, constant temperature.

Figure 6:
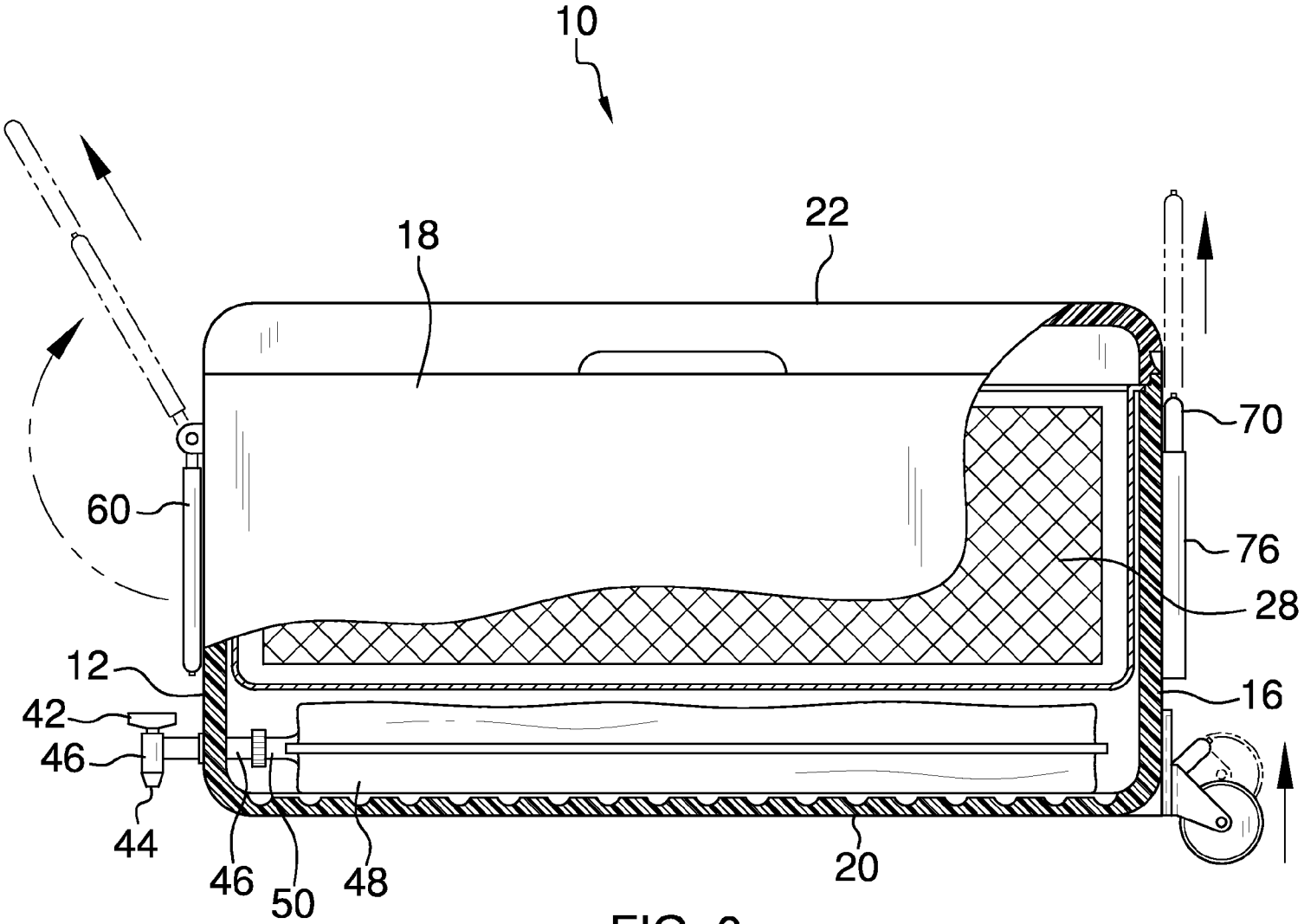
FIG. 6 is a side cross-sectional view of the present invention.

FIG. 6 illustrates the liquid container 48 engaged with the dispenser 40 and positioned below the strainer 28. Once the contents of the liquid container 48 are eliminated, the strainer 28 is removed, the container 48 disengaged from the dispenser, and another container having a single liquid conduit or a duel liquid conduit can be used as a replacement.

On the front wall 14 a generally U-shaped extendable front handle 60 having a release button 62 is disposed on a frame consisting of a pair of rods 64 having first and second ends. The second end of the rods 64 is mounted to the exterior surface of the front wall 14. The handle 60 is extendable through well known telescoping means, and is retractable to a stored positioned against the front wall 14.

On the rear wall 16, an extendable handle 70 having a pair of parallel arms 72 and a release button 74 is disposed on a support frame 76 comprised of a pair of longitudinal upright guide channels 78. The guide channels 78 are mounted on the exterior surface of the rear wall 16.

A pair of retractable wheels 80 positioned at opposed ends of a rod 82, with a release button 84 disposed on the rod 82, are mounted on the rear wall below the extendable handle 70. When the release button 84 is depressed the rod 82 rotates downwardly and allows the wheels to touch the ground surface and provide support for the body 12.

The handles 60, 70 and the wheels 80 can be adjusted for lifting and transport. The rear wall 16 may have a recessed cavity 90 to allow the wheels to rotate to a stored position so that the exterior surface of the bottom wall lies flat on the ground.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims attached.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description only and should not be regarded as limiting the scope and intent of the invention.

I claim:

1. A portable cooler, comprising in combination:

an insulated body defining a cavity therein having a front wall, a rear wall, side walls and a bottom wall having a plurality of recessed wells and recessed channels integrally formed therein, the channels being aligned parallel and perpendicular to each other forming a plurality of squares with the recessed wells intersecting and connecting at the corner of each square; and an insulated lid mountable on the body.

2. The cooler as set forth in claim 1, further comprising a container dimensioned to be mounted in the body.

3. The cooler as set forth in claim 2, whereby the body has an inner ridge formed along an inner surface, and whereby the container is a strainer with end walls, side walls and a bottom wall, with passages formed through the walls therethrough, and further having a lip depending outwardly from an upper surface of the wall of the strainer to mount on the inner ridge of the body.

4. The cooler as set forth in claim 3, further comprising an extendable handle mounted on the front wall of the body, a rear handle mounted on the rear wall of the body and a pair of retractable wheels mounted on the rear wall positioned below the extendable handle.

5. The cooler as set forth in claim 3, further comprising a pair of liquid dispensers, each having a control mechanism and an outlet at a first end, disposed through the front wall, and further each dispenser having an inlet port at a second end positioned in the cavity of the body.

6. The cooler as set forth in claim 5, further comprising a liquid container integrally formed with a conduit mateable with one of the inlet ports of the liquid dispensers.

7. The cooler as set forth in claim 5, further comprising a liquid container integrally formed with a pair of conduits mateable with the inlet ports of the liquid dispensers.

8. A portable cooler, comprising in combination:

an insulated body defining a cavity therein having a front wall, a rear wall, side walls and a bottom wall having a plurality of recessed wells and recessed channels integrally formed therein; the channels being aligned parallel and perpendicular to each other forming a plurality of squares with the recessed wells intersecting and connecting at the corner of each square, and whereby the body has an inner ridge formed along an inner surface;

a strainer with end walls, side walls and a bottom wall, with passages formed through the walls therethrough, and further having a lip depending outwardly from an upper surface of the wall of the strainer to mount on the inner ridge of the body;

a pair of liquid dispensers, each having a control mechanism and an outlet at a first end, disposed through the front wall, and further each dispenser having an inlet port at a second end positioned in the cavity of the body; and an insulated lid mountable on the body.

* * * * *